US006522238B2

(12) United States Patent
Nagao et al.

(10) Patent No.: US 6,522,238 B2
(45) Date of Patent: Feb. 18, 2003

(54) SEMICONDUCTOR CERAMIC AND POSITIVE-TEMPERATURE-COEFFICIENT THERMISTOR

(75) Inventors: Yoshitaka Nagao, Omihachiman (JP); Yasuhiro Nabika, Omihachiman (JP); Toshiharu Hirota, Hikone (JP)

(73) Assignee: Murata Manufacturing Co. Ltd. (JP)

( * ) Notice: Subject to any disclaimer, the term of this patent is extended or adjusted under 35 U.S.C. 154(b) by 0 days.

(21) Appl. No.: 09/903,037

(22) Filed: Jul. 11, 2001

(65) Prior Publication Data

US 2002/0027492 A1 Mar. 7, 2002

(30) Foreign Application Priority Data

Jul. 21, 2000 (JP) ..... 2000-220693

(51) Int. Cl.[7] ..... H01C 7/10

(52) U.S. Cl. ..... 338/22 R; 338/22; 338/5 D; 252/519.1; 252/519.12

(58) Field of Search ..... 338/22 R, 22 SD; 252/519.1, 519.12, 519.15

(56) References Cited

U.S. PATENT DOCUMENTS 3,996,168 A * 12/1976 Hoffmann et al. ..... 252/520
4,096,098 A * 6/1978 Umeya et al. ..... 252/520
6,071,842 A * 6/2000 Takahashi et al. ..... 501/137

FOREIGN PATENT DOCUMENTS

| | | | |
|---|---|---|---|
| JP | 51038091 | * | 3/1976 |
| JP | 0123462 | * | 9/1989 |
| JP | 6-215905 | | 8/1994 |
| JP | 2000-143338 | | 5/2000 |

* cited by examiner

*Primary Examiner*—Karl D. Easthom
(74) *Attorney, Agent, or Firm*—Dickstein, Shapiro, Morin & Oshinsky, LLP.

(57) ABSTRACT

A semiconductor ceramic contains erbium as a semiconducting agent in primary components of barium titanate, strontium titanate, lead titanate and calcium titanate, with the average grain diameter of the semiconductor ceramic exceeding about 5 μm but not exceeding about 14 μm. Further, the semiconductor ceramic contains as additives a compound containing Er with the Er being more than about 0.10 mol but no more than about 0.33 mol, a compound containing Mn with the Mn being about 0.01 mol or more but no more than about 0.03 mol, and a compound containing Si with the Si being about 1.0 mol or more but no more than about 5.0 mol, per 100 mol of the primary component. Thus, a semiconductor ceramic and positive-temperature-coefficient thermistor can be provided with high-flash-breakdown capability, excellent results in ON-OFF application tests and few irregularities in resistance values.

10 Claims, 1 Drawing Sheet

SEMICONDUCTOR CERAMIC AND POSITIVE-TEMPERATURE-COEFFICIENT THERMISTOR

BACKGROUND OF THE INVENTION

1. Field of the Invention

The present invention relates to a semiconductor ceramic and positive-temperature-coefficient thermistor, and particularly relates to a semiconductor ceramic and positive-temperature-coefficient thermistor having high resistance temperature properties, with high-flash-breakdown capability necessary with degaussing for color televisions, motor starters, overcurrent protectors and so forth.

2. Description of the Related Art

Japanese Unexamined Patent Application Publication No. 6-215905 discloses a semiconductor ceramic wherein erbium is contained as a semiconducting agent in primary components of barium titanate, lead titanate, strontium titanate and calcium titanate, which are used for degaussing in color televisions.

Also, Japanese Unexamined Patent Application Publication No. 2000-143338 discloses a semiconductor ceramic wherein samarium oxide is contained as a semiconducting agent in primary components barium titanate, lead titanate, strontium titanate and calcium titanate, with the average grain diameter of the semiconductor ceramic being between 7 to 12 $\mu$m.

However, each of the above semiconductor ceramics have inferior high-flash-breakdown capability, exhibit unsatisfactory results in ON-OFF application tests, and also had great irregularities in specific resistance values at room temperature. Accordingly, a semiconductor ceramic and positive-temperature-coefficient thermistor having high resistance temperature properties with high-flash-breakdown capability such as necessary for degaussing for color televisions, motor starters, overcurrent protectors and so forth, has not been obtained.

SUMMARY OF THE INVENTION

Accordingly, it is an object of the present invention to provide a semiconductor ceramic and positive-temperature-coefficient thermistor which has high-flash-breakdown capability, exhibits excellent results in ON-OFF application tests and also has few irregularities in specific resistance values at room temperature.

To this end, the semiconductor ceramic according to the present invention is a semiconductor ceramic wherein erbium is contained as a semiconducting agent in primary components barium titanate, strontium titanate, lead titanate and calcium titanate, with the average grain diameter of the semiconductor ceramic exceeding about 5 $\mu$m but not exceeding about 14 $\mu$m.

The semiconductor ceramic with the above composition has high-flash-breakdown capability, exhibits excellent results in ON-OFF application tests and has few irregularities in resistance values.

The semiconductor ceramic according to the present invention preferably contains an additive compound containing Er with the Er being more than about 0.10 mol but no more than about 0.33 mol, a compound containing Mn with the Mn being about 0.01 mol or more but no more than about 0.03 mol, and a compound containing Si with the Si being about 1.0 mol or more but no more than about 5.0 mol, per 100 mol of the primary component.

Further, the positive-temperature-coefficient thermistor according to the present invention comprises an element member of the semiconductor ceramic with electrodes provided on the front and back sides.

DESCRIPTION OF THE PREFERRED EMBODIMENTS

Figure 1:
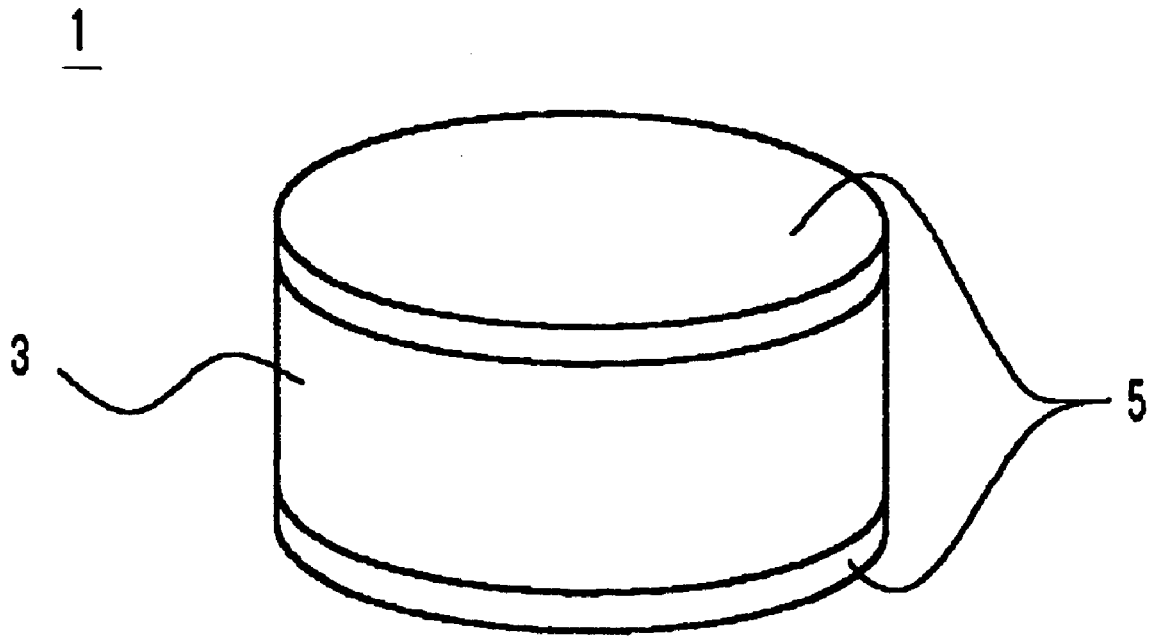
FIG. 1 is a schematic perspective view of a positive-temperature-coefficient thermistor using the semiconductor ceramic according to the present invention.

The following is a description of embodiments of the semiconductor ceramic and positive-temperature-coefficient thermistor according to the present invention.

FIG. 1 illustrates a positive-temperature-coefficient thermistor 1 manufactured using the semiconductor ceramic according to the present invention. This positive-temperature-coefficient thermistor 1 comprises electrodes provided upon the front and back sides of a semiconductor ceramic element member 3. The semiconductor ceramic comprising the element member 3 has erbium as a semiconducting agent in the primary components barium titanate, strontium titanate, lead titanate and calcium titanate. The electrodes 5 can be formed of Ni—Ag.

The following is a description of the method of manufacturing the positive-temperature-coefficient thermistor and the properties of the semiconductor ceramic.

First, $BaCO_3$, $TiO_2$, PbO, $SrCO_3$ and $CaCO_3$, were prepared as primary components, along with $Er_2O_3$ as a semiconducting agent, and other additives such as $MnCO_3$ serving as an agent for improving resistance-temperature coefficients and $SiO_2$ as an agent for aiding sintering. These were prepared at the ratios shown in Table 1 and wet-blended, thus obtaining mixtures. Next, the obtained mixtures were dehydrated and dried, pre-baked at 1200° C. and mixed with a binder to obtain granulate particles. The granulate particles were subjected to uniaxial pressing and were thereby formed into a disc 2 mm in thickness and 14 mm in diameter, and baked at 1390° C. in the ambient atmosphere, thereby obtaining the semiconductor ceramic element member 3.

The surface of the semiconductor ceramic element member 3 obtained was photographed using a scanning electron microscope (SEM) and the average grain diameter was obtained by sectioning.

Next, as shown in FIG. 1, Ni—Ag electrodes 5 were provided on both primary faces of the semiconductor ceramic element member 3, thereby obtaining the positive-temperature-coefficient thermistor 1. The Ni—Ag electrodes 5 were formed by forming an Ni layer as a ohmic electrode layer, and the further forming an Ag layer as an outermost electrode layer upon the Ni layer.

The specific resistance values temperature (25° C.) of the positive-temperature-coefficient thermistor 1, flash breakdown, and ON-OFF application testing under 140 V at −10° C., were measured for 1,000 cycles. The measurement results are shown in Table 1, along with the average grain diameters. Note that the amounts added (mol%) of the semiconducting agent and additives in Table 1 indicate the ratio thereof to the primary components. Further, the asterisks * in Table 1 indicate items which are not within the preferred scope of the present invention.

As shown in Table 1, the samples wherein the average grain diameter of the semiconductor ceramic exceeds about 5 μm but not about 14 μm, and contains the semiconducting agent Er of more than about 0.10 mol but no more than about 0.33 mol, the additive Mn of about 0.01 mol or more but no more than about 0.03 mol, and Si of about 1.0 mol or more but no more than about 5.0 mol, each have high-flash-breakdown capability and exhibit excellent results in ON-OFF application tests.

TABLE 1

| Sample No. | Primary component $BaTiO_3$ (mol %) | $PbTiO_3$ (mol %) | $SrTiO_3$ (mol %) | $CaTiO_3$ (mol %) | Semi-conducting agent $ErO_{3/2}$ (mol %) | Additive $MnO_2$ (mol %) | $SiO_2$ (mol %) | Specific Ave. grain diameter (μm) | resistance at room temperature (Ωcm) | Flash-breakdown capability (V/Ωcm) | ON-OFF test (1000 cycles) |
|---|---|---|---|---|---|---|---|---|---|---|---|
| *1 | 65 | 2 | 18 | 15 | 0.100 | 0.010 | 2.0 | 14 | 12 | 12.2 | 10/10F |
| *2 | 65 | 2 | 18 | 15 | 0.100 | 0.020 | 2.0 | 13 | 31 | 5.2 | 10/10F |
| *3 | 65 | 2 | 18 | 15 | 0.100 | 0.030 | 2.0 | 15 | 297 | 0.8 | 10/10F |
| 4 | 65 | 2 | 18 | 15 | 0.150 | 0.010 | 2.0 | 14 | 8 | 33.0 | Passed |
| 5 | 65 | 2 | 18 | 15 | 0.225 | 0.020 | 2.0 | 12 | 9 | 31.2 | Passed |
| 6 | 65 | 2 | 18 | 15 | 0.225 | 0.025 | 2.0 | 11 | 11 | 28.3 | Passed |
| 7 | 65 | 2 | 18 | 15 | 0.225 | 0.030 | 2.0 | 12 | 13 | 23.5 | Passed |
| 8 | 65 | 2 | 18 | 15 | 0.250 | 0.020 | 2.0 | 11 | 10 | 40.3 | Passed |
| 9 | 65 | 2 | 18 | 15 | 0.250 | 0.025 | 2.0 | 10 | 12 | 32.3 | Passed |
| 10 | 65 | 2 | 18 | 15 | 0.250 | 0.030 | 2.0 | 9 | 14 | 28.8 | Passed |
| 11 | 65 | 2 | 18 | 15 | 0.300 | 0.020 | 2.0 | 8 | 14 | 31.3 | Passed |
| 12 | 65 | 2 | 18 | 15 | 0.300 | 0.025 | 2.0 | 8 | 14 | 31.3 | Passed |
| 13 | 65 | 2 | 18 | 15 | 0.300 | 0.030 | 2.0 | 7 | 15 | 32.1 | Passed |
| 14 | 65 | 2 | 18 | 15 | 0.330 | 0.025 | 2.0 | 8 | 15 | 29.5 | Passed |
| *15 | 65 | 2 | 18 | 15 | 0.330 | 0.030 | 2.0 | 4 | 17 | 13.2 | 3/10F |
| *16 | 65 | 2 | 18 | 15 | 0.350 | 0.020 | 2.0 | 5 | 15 | 13.3 | 4/10F |
| *17 | 65 | 2 | 18 | 15 | 0.350 | 0.030 | 2.0 | 4 | 16 | 14.0 | 3/10F |
| *18 | 65 | 2 | 18 | 15 | 0.150 | 0.033 | 2.0 | 10 | 125 | 1.8 | 10/10F |
| 19 | 65 | 2 | 18 | 15 | 0.150 | 0.015 | 2.0 | 13 | 9 | 30.1 | Passed |
| *20 | 65 | 2 | 18 | 15 | 0.150 | 0.005 | 2.0 | 15 | 6 | 17.1 | 2/10F |
| *21 | 65 | 2 | 18 | 15 | 0.250 | 0.025 | 0.5 | 6 | 6 | 17.0 | 6/10F |
| 22 | 65 | 2 | 18 | 15 | 0.250 | 0.025 | 1.0 | 8 | 10 | 24.0 | Passed |
| 23 | 65 | 2 | 18 | 15 | 0.250 | 0.025 | 5.0 | 12 | 15 | 26.0 | Passed |
| *24 | 65 | 2 | 18 | 15 | 0.250 | 0.025 | 7.0 | Fuses | Fuses | Fuses | Fuses |

Semiconductor ceramics were also manufactured using the procedures described above but $Y_2O_3$, $Sm_2O_3$ and $La_2O_3$, were used as semiconducting agents instead of the $Er_2O_3$, and these were evaluated. The composition of the semiconducting agents of the semiconductor ceramics and the evaluation results thereof are shown in Table 2. Also, the $Er_2O_3$ is the same as sample No. 9 in Table 1. Further, the asterisks * in Table 2 indicate items which are not within the scope of the present invention.

TABLE 2

| Sample No. | Primary component $BaTiO_3$ (mol %) | $PbTiO_3$ (mol %) | $SrTiO_3$ (mol %) | $CaTiO_3$ (mol %) | Semi-conducting agent Type | Amount | Additive $MnO_2$ (mol %) | $SiO_2$ (mol %) | Ave. grain diameter (μm) | Specific resistance at room temperature (Wcm) Ave. | CV % | Flash-breakdown capability (V/Wcm) | ON-OFF test (1000 cycles) |
|---|---|---|---|---|---|---|---|---|---|---|---|---|---|
| 25 | 65 | 2 | 18 | 15 | $ErO_{3/2}$ | 0.250 | 0.025 | 2 | 10 | 12 | 1.5 | 375 | Passed |
| *26 | 65 | 2 | 18 | 15 | $YO_{3/2}$ | 0.250 | 0.025 | 2 | 9 | 11 | 2.0 | 380 | Passed |
| *27 | 65 | 2 | 18 | 15 | $SmO_{3/2}$ | 0.250 | 0.025 | 2 | 7 | 8 | 3.2 | 284 | Passed |
| *28 | 65 | 2 | 18 | 15 | $LaO_{3/2}$ | 0.250 | 0.025 | 2 | 7 | 9 | 3.5 | 301 | Passed |

As shown in Table 2, the results of the flash-breakdown capability and ON-OFF application tests were good for each sample, but while the samples using $Y_2O_3$, $Sm_2O_3$, and $La_2O_3$ as semiconducting agents exhibited values of 2.0 to 3.5 CV % as room temperature resistance irregularities, the $Er_2O_3$ sample exhibited 1.5 CV % as room temperature resistance irregularities, which is small.

The semiconductor ceramic and positive-temperature-coefficient thermistor according to the present invention are by no means restricted to the above embodiments or examples; rather, many variations may be made within the spirit and scope of the present invention. For example, the element member formed of the semiconductor ceramic has been described as having a disc shape, but the present invention is not restricted to this; the shape may be rectangular instead, for example.

As can be clearly understood from the foregoing description, the semiconductor ceramic according to the present invention is a semiconductor ceramic wherein erbium is contained as a semiconducting agent in the primary components barium titanate, strontium titanate, lead titanate and calcium titanate, with the average grain diameter of the semiconductor ceramic exceeding about 5 μm but not exceeding about 14 μm, and accordingly, the semiconductor ceramic according to the present invention has high-flash-breakdown capability and exhibits excellent results in ON-OFF application tests.

The semiconductor ceramic, by containing, as additives, a compound containing Er with the Er contained being more than about 0.10 mol but no more than about 0.33 mol, a compound containing Mn with the Mn being about 0.01 mol or more but no more than about 0.03 mol, and a compound containing Si with the Si being about 1.0 mol or more but no more than about 5.0 mol, per 100 mol of the primary component, can yield high-flash-breakdown capability, exhibit excellent results in ON-OFF application tests and allow resistance value irregularities CV % to be reduced.

Further, a positive-temperature-coefficient thermistor with excellent properties such as high-flash-breakdown capability can be obtained by using the above-described semiconductor ceramic.

What is claimed is:

1. A semiconductor ceramic, comprising:

a primary component containing barium titanate, strontium titanate, lead titanate and calcium titanate and an erbium-containing material semiconducting agent;

wherein the average grain diameter of said semiconductor ceramic exceeds 5 $\mu$m but does not exceed 14 $\mu$m.

2. A semiconductor ceramic according to claim 1, wherein the compound containing Er is present in an amount of at least 0.10 mol but no more than 0.33 mol per 100 moles of the primary component.

3. A semiconductor ceramic according to claim 2 further comprising a compound containing Mn in an amount of at least 0.01 mol but no more than 0.03 mol per 100 mols of the primary component.

4. A semiconductor ceramic according to claim 3 further comprising a compound containing Si in an amount of at least 1.0 mol but no more than 5.0 mol per 100 mols of the primary component.

5. A semiconductor ceramic according to claim 4, wherein the compound containing Er is present in an amount of 0.225 to 0.3 mol per 100 mols of the primary component.

6. A positive-temperature-coefficient thermistor, comprising a semiconductor ceramic according to claim 5 in combination with a pair of spaced electrodes.

7. A positive-temperature-coefficient thermistor, comprising a semiconductor ceramic according to claim 4 in combination with a pair of spaced electrodes.

8. A positive-temperature-coefficient thermistor, comprising a semiconductor ceramic according to claim 3 in combination with a pair of spaced electrodes.

9. A positive-temperature-coefficient thermistor, comprising a semiconductor ceramic according to claim 2 in combination with a pair of spaced electrodes.

10. A positive-temperature-coefficient thermistor, comprising a semiconductor ceramic according to claim 1 in combination with a pair of spaced electrodes.

* * * * *